United States Patent [19]

Figueroa

[11] Patent Number: 4,502,464

[45] Date of Patent: Mar. 5, 1985

[54] STOVE

[76] Inventor: Alberto A. Figueroa, San Lorenzo, Gapan, Nueva Ecija, Philippines

[21] Appl. No.: 577,982

[22] Filed: Feb. 8, 1984

[30] Foreign Application Priority Data

Feb. 23, 1983 [PH] Philippines ..... 28556

[51] Int. Cl.[3] ..... F23M 5/00; F24B 13/02

[52] U.S. Cl. ..... 126/163 R; 126/147; 126/290; 110/251

[58] Field of Search ..... 126/144–148, 126/151, 163 R, 163 A, 58, 211, 218, 77, 290, 65, 149; 110/233, 248, 251, 234, 254

[56] References Cited

U.S. PATENT DOCUMENTS

| | | | |
|---|---|---|---|
| 747,998 | 12/1903 | Morgan | 126/146 |
| 1,179,245 | 4/1916 | Walters | 126/163 A |
| 1,246,416 | 11/1917 | Gibbs | 126/146 |
| 1,952,227 | 3/1934 | Adams | 126/146 |
| 4,338,915 | 7/1982 | Mortonfi, Sr. | 126/151 |
| 4,436,081 | 3/1984 | Hefling | 126/146 |

FOREIGN PATENT DOCUMENTS

| | | | |
|---|---|---|---|
| 195379 | 2/1908 | Fed. Rep. of Germany | 126/146 |

*Primary Examiner*—James C. Yeung

[57] ABSTRACT

This invention is for a stove having a cylindrical body with holes circumferentially disposed on the sides thereof and which holes gradually increase in number and in size towards the top thereof. The cylindrical body has an open top and a bottom wall and supported by legs at the bottom thereof. Disposed within the cylindrical body and spaced from the bottom wall are vertically spaced apart plates, the upper of said plates being perforated and both plates are connected to a central downwardly extending short cylinder communicating with the space above the bottom wall which has primary inlet openings with an adjustable rotatable plate for opening said primary inlet opening. Resting on the short cylinder is the vertical cylindrical screen, and at the top of said cylindrical body is a cover which has a flame opening defined by a short upwardly and downwardly protruding short cylinder. At the bottom of said cover is suspended a fuel top shield with a central opening.

5 Claims, 3 Drawing Figures

STOVE

This invention relates specifically to a stove which uses organic wastes, such as palay husks, saw dust, wood chips and others as fuel.

It has been noted that in present stoves or burners using organic wastes, burning of the fuel is not steady and regular and much difficulty is encountered in regulating the burning of the fuel. Most frequently combustion is not complete such that much of the organic waste fuel remains unburned after using the stoves.

The object then of this invention is to provide a stove which uses organic waste fuel such as palay husks, saw dust, wood chips and other organic waste material in powdered, granular or particle form which stove could effect steady, regular and complete combustion of said aforementioned types of fuel.

Another object is to provide an efficiently burning stove which has a very simple construction and easy to fabricate.

An object also of this invention is to provide a stove which is very economical to use and has a minimum of residual ash.

A further object is to provide a simple stove which is safe and easy to use.

It is also an object of this invention to provide a stove using organic waste material which is light and portable and so could be used indoors or outdoors.

The aforementioned objects as well as those inherent in this invention will be fully appreciated after reading the following detailed description of the appended drawings, which form part of the specification and wherein.

Figure 1:
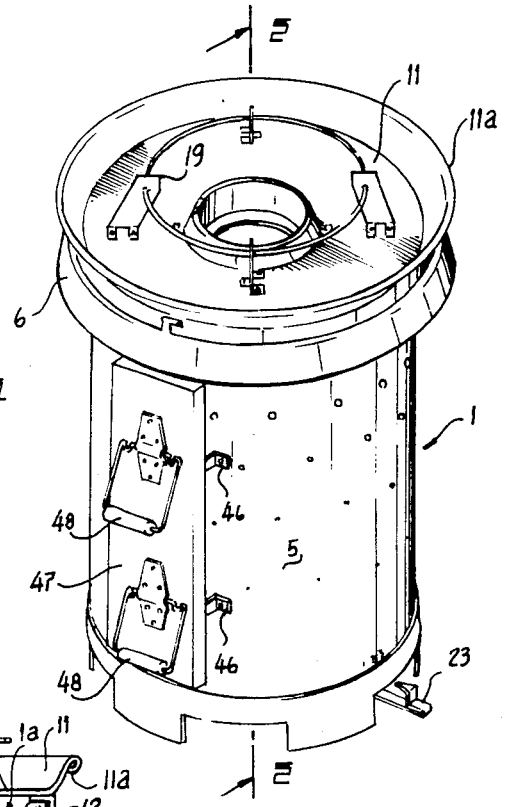
FIG. 1 is a pictorial view of the stove in accordance with this invention.
Figure 2:
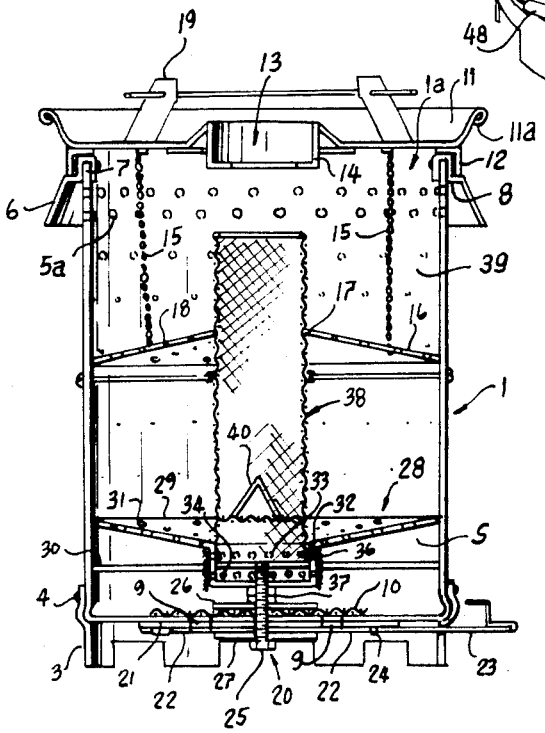
FIG. 2 is a vertical cross-sectional view of the stove taken along line 2-2 of FIG. 1.
Figure 3:
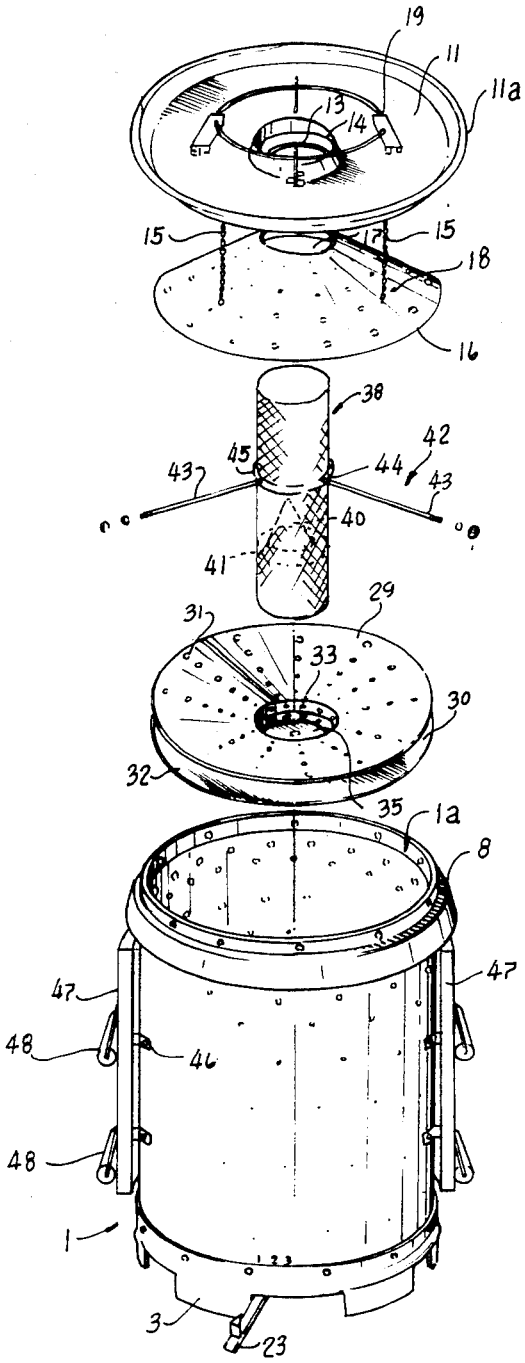
FIG. 3 is a partial exploded view of this stove.

This stove has an upstanding cylindrical body 1 with an open top 1*a*, a bottom wall 2 secured to the bottom thereof and a unitary support 3 secured by screws 4 to the bottom portion thereof.

The cylindrical body has a plurality of holes 5 arranged circumferentially thereon and which holes gradually increase in number and in size towards the top thereof such that the holes 5*a* at the top are larger and more numerous than the holes 5 at the lower portion of said cylindrical body. The large and numerous holes at the top of the cylindrical body are provided with an annular baffle wall 6 secured to the top rim 7 of said cylindrical body. This annular baffle wall has a shoulder 8 downwardly of the top rim 7. Said annular baffle wall guides the hot air from the outer sides of the cylindrical body into the large holes to augment the combustion of the gases. The bottom wall on the other hand has several circularly spaced apart arcuate openings 9 at the central portion thereof which serve as the primary air inlet. These primary air inlet openings are covered on top by a screen 10.

Disposed on top of the cylindrical body 1 is the detachable cover 11 which has a downwardly extending annular skirt 12 fitted to the upper portion of the annular baffle wall and seated on the shoulder 8 thereof. Said detachable cover has a central flame opening 13 defined by the short cylindrical wall 14 which protrudes from the top and bottom sides thereof. Secured to the bottom of said detachable cover are the diametrically opposed chains 15. Suspended on said chains is the frusto-conical shaped top fuel plate or shield 16 which has a central opening 17. This shield maybe provided with a plurality of holes 18. Said shield helps concentrate the flame to the center of the flame opening. The detachable cover 11 has an upturned peripheral rim 11*a* to catch overflowing liquid while cooking, and is provided on the top side thereof with cooking utensil supports 19.

Below the bottom wall 2 is the adjustable primary air control unit 20 which consists of a rotatable disc plate 21 with holes 22 corresponding with the holes or openings 9 on the bottom wall, and a lever 23 secured by rivets 24 to said rotatable disc plate. The rotatable disc plate is pivotally mounted on the bolt 25 to which the top retainer plate 26 and the bottom retainer plate 27 are secured. Said primary air control unit together with the openings of the bottom wall constitute the adjustable primary air inlet.

Disposed in the cylindrical body and slightly spaced upwardly from the bottom wall thereof is the combined fuel base support and air-gas vapor chamber unit 28 which consists of two vertically spaced apart perforated upper plate 29 and an imperforate lower plate 30. The perforations 31 on the upper plate are radially and circularly arrange with the size of said perforations, preferably increasing in size, towards the peripheral side of the plate. This perforated upper plate serves as the fuel base support and the space S between the upper perforated plate and the imperforate lower plate constitute the air-gas vapor chamber. The arrangement and sizes of the perforations on the upper plate contribute to the uniform and steady burning of the fuel.

Said upper and lower plates 29 and 30 have identical central openings defined by the downwardly extending short cylindrical member 32. This short cylindrical member 32 is secured to said plates and has a plurality of openings 33 at the upper section thereof between the upper and lower plates, and similar openings 34 at the lower section thereof which protrudes downwardly of the lower imperforate plate, and a bottom wall 35 with a center hole through which the bolt 25 protrudes. The holes 33 and 34 are covered by a screen 36 to prevent or minimize the fall of ashes or fuel to the primary air control. The bottom wall 35 rests on the washers 37 provided on said bolt 25 to elevate said bottom wall 35 spacedly from the bottom wall 2 of the cylindrical body.

Supported by the upper end of the bolt 25 is the bottom vertical cylindrical screen fuel support 38. The bottom end of this vertical cylindrical screen fits into the upper section of the short cylindrical member of the air-gas vapor chamber unit. This vertical cylindrical screen fuel support forms with the cylindrical body 1 an annular fuel chamber 39. Said cylindrical screen fuel support is provided with a conical shell 40 rested on a horizontal cylindrical screen wall 41 spaced from the bottom end thereof. To center said cylindrical fuel screen and keep it in vertical position, there is provided a centering means 42. This centering means consists of radial wires 43 the outer ends of which are secured to the cylindrical body and the inner end 44 of which are secured to a center ring 45 which fits around said cylindrical screen fuel support.

Secured to the cylindrical body are vertically spaced apart brackets 46 to which the side shields 47 are secured. To the side shields are secured the handles 48. Two of these shields are provided and are disposed diametrically opposite each other.

To use this stove, the detachable cover is removed and the primary air control unit opened. Fuel in particle or granular form is poured to fill the fuel chamber then the detachable cover is put in place and lighted balls or pieces of crumpled paper is dropped into the cylindrical screen fuel support down to the conical shell which positions the ignited material close to the sides of the cylindrical screen causing the burning of the adjacent fuel. As the burning of the fuel starts, heated gas and vapor from the burning fuel passes through the holes on the upper plate of the air-gas vapor chamber unit which combine with the air coming through the primary air inlet openings. This combined gas vapor and air enters the lower end portion of the cylindrical screen causing steady and efficient burning of the fuel. Additional air enters the holes on the sides of the cylindrical body providing an upwardly flowing air supply which supports the steady burning and at the same time concentrating the flame to the center at the flame opening of the detachable cover.

I claim:

1. A stove comprising a cylindrical body open at the top and having a bottom wall and a support at the bottom thereof, said cylindrical body having a plurality of circumferentially disposed holes at the sides thereof which holes increase and size towards the top thereof, said bottom wall has several circularly spaced apart openings at the central portion thereof, an adjustable primary air control means disposed below said bottom wall, an air-gas vapor chamber disposed above said bottom wall and communicating therewith, said air-gas vapor chamber unit having a downwardly extending short cylindrical member having circumferential openings, a vertical cylindrical screen fuel support disposed centrally of said cylindrical body with the bottom thereof substantially extending to said short cylindrical portion and communicating with said air-gas vapor chamber, a detachable cover disposed on top of said cylindrical body, said cover having a centrally disposed flame opening, a cooking utensil support at the topside thereof and a top fuel shield suspended below said detachable cover.

2. A stove as defined in claim 1 wherein said air-gas vapor chamber includes a perforated upper plate and a downwardly spaced apart imperforate lower plate, both said plates having central openings to which a short cylindrical member is disposed and secured.

3. A stove as defined in claim 1 wherein said cylindrical body has an annular baffle at the top thereof around the cylindrical body.

4. A stove as defined in claim 1 wherein said cover has a pair of chains at the lower side thereof and on which chains is suspended said top fuel shield which has a central opening through which said cylindrical screen fuel support protrudes.

5. A stove as defined in claim 1 wherein said primary air control means includes a rotatable disc plate having circularly spaced apart openings corresponding to that on said bottom wall, and a lever for operating said rotatable disc plate to register said corresponding openings to open or close said openings.

* * * * *